US007523624B2

(12) United States Patent
Bausch et al.

(10) Patent No.: US 7,523,624 B2
(45) Date of Patent: Apr. 28, 2009

(54) LATCH NEEDLE FOR A LOOP-FORMING TEXTILE

(75) Inventors: Albert Bausch, Burladingen-Melchingen (DE); Hans-Wolfgang Schmoll, Haigerloch (DE); Jochen Braun, Nusplingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/819,074

(22) Filed: Jun. 25, 2007

(65) Prior Publication Data

US 2008/0173046 A1 Jul. 24, 2008

(30) Foreign Application Priority Data

Jun. 26, 2006 (EP) ..... 06013100

(51) Int. Cl.
*D04B 35/04* (2006.01)

(52) U.S. Cl. ..... 66/121

(58) Field of Classification Search ..... 66/121, 66/122, 123, 116
See application file for complete search history.

(56) References Cited

U.S. PATENT DOCUMENTS

| | | | | |
|---|---|---|---|---|
| 773,722 A | | 11/1904 | Egly | |
| 1,779,249 A | * | 10/1930 | Parlini | 66/117 |
| 1,824,445 A | * | 9/1931 | Parlini | 66/117 |
| 2,282,824 A | * | 5/1942 | Primm | 66/121 |
| 3,031,867 A | * | 5/1962 | Wiederhut et al. | 66/121 |
| 3,164,000 A | * | 1/1965 | Ashe | 66/121 |
| 3,222,891 A | * | 12/1965 | Wignall | 66/121 |
| 3,728,874 A | | 4/1973 | Kelly et al. | |
| 4,096,713 A | | 6/1978 | Lopes, Jr. et al. | |
| 4,498,315 A | * | 2/1985 | Wohlgemuth | 66/121 |
| 4,512,164 A | * | 4/1985 | Fukuhara | 66/121 |
| 4,656,841 A | * | 4/1987 | Mayer | 66/121 |
| 6,230,523 B1 | * | 5/2001 | Apollonio | 66/123 |
| 2002/0152774 A1 | | 10/2002 | Sauter et al. | |

FOREIGN PATENT DOCUMENTS

| | | |
|---|---|---|
| DE | 28 34 558 | 2/1979 |
| DE | 100 57 765 | 10/2001 |
| EP | 0 077 022 A1 | 4/1983 |
| WO | WO 02/08506 A1 | 1/2002 |

* cited by examiner

*Primary Examiner*—Danny Worrell
(74) *Attorney, Agent, or Firm*—Fitch, Even, Tabin & Flannery; Norman N. Kunitz

(57) ABSTRACT

A latch needle (1) having on its latch (7) a latch head (9) that is provided with a recess or a depression (12) for receiving a section of a tip (14) of the hook (4), said tip having the configuration of a truncated cone. The latch head (9) is wider than the latch shaft (8) of the latch (7), however, distinctly narrower than the needle shaft (20). Due to this measure, too great an expansion of the loops during the casting-off process is avoided, and the risk of a collision of the latch head with other components, for example, sinkers, is reduced.

18 Claims, 4 Drawing Sheets

Play needed in the latch bearing

LATCH NEEDLE FOR A LOOP-FORMING TEXTILE

CROSS REFERENCE TO RELATED APPLICATION

This application claims the priority of German Patent Application No. 06 013 100.0, filed on Jun. 26, 2006, the subject matter of which, in its entirety, is incorporated herein by reference.

BACKGROUND TO THE INVENTION

The invention relates to a latch needle for a loop-forming machine, in particular for a knitting machine, for the production of flat textiles.

In order to form loops of a minimum of one thread, so-called latch needles are used in machines, in particular knitting machines, whereby, in operative mode, said needles are moved back and forth in rapid succession. In so doing, the latch provided on such a latch needle opens and closes a receiving space in rapid succession and at high speed. When the latch changes from closed position into the rear position, the latch head performs an oscillating movement in the form of an arc of a circle. In so doing, the latch alternately impacts on the hook in rapid succession in order to create the closed position, as well as on the shaft of the latch needle, in order to create the open position or rear position.

The thread-receiving space is limited by a needle base body and its hook on one end while interacting with the opening and closing latch. If so-called small-grooved latch needles are used, the tip of the hook sinks into a depression in the noucat at the end of the latch. By receiving the hook tip in the depression of the latch head, it is ensured that the hook tip is almost fully covered by the latch head. This facilitates casting off the half-loops via the latch head and thus facilitates the loop formation. During the casting-off process, the half-loop slides from the upper side of the needle over the latch shaft and subsequently over the latch head. The relatively wide latch head facilitates the interaction of the latch head and the hook, in that the latch head reliably impacts on the hook, even in cases of greater latch bearing tolerances.

The latch needles are held in a needle carrier so that they can be moved back and forth, in which case said needles are moved back and forth in longitudinal direction—controlled by cams—in order to form loops. In order to ensure the rapid back and forth movement, the shaft width of a latch needle is slightly smaller than the width of a needle channel associated with said needle. Based on the existing manufacturing tolerance of the needle channels and the needle shaft width, it is possible that a latch needle—affected by the rotation of the needle carrier of a circular knitting machine—is inclined with respect to the center axis of a guide channel.

Referring to a circular knitting machine, sometimes up to 6,000 knitting machine needles are arranged at a small distance from each other. In addition, between each two needles there is respectively one sinker that is required for the loop-forming process. On the one hand, this sinker aids the so-called casting-off of the loops over the closed latch and, on the other hand, it holds down the knit product.

As a result of the tolerances existing in the guide channel of the needle bed and the tolerances in the region of the latch bearing, the knitting machine needle and its latch are respectively displaced with respect to their ideal position. These tolerances increase because of the wear during prolonged use of the knitting machine needle, thus also causing the lateral displacement of the latch to be increased. Referring to knitting machines, which have little intermediate space for the passage of the latch between the needles and the sinkers during the oscillating movement, contact may occur between the latch head and a sinker adjacent to said head. In so doing, the sinker, as well as the latch head are worn, which is disadvantageous.

In order to avoid this, so-called male latch-female hook type latch needles have been suggested. In so doing, document DE OS 28 34 558 discloses a knitting machine needle having a hook, which, in the region of the tip has a relatively deep depression. This depression receives part of the latch spoon, whereby said depression is limited by two lateral surfaces arranged at an acute angle with respect to each other, said lateral surfaces partially extending beyond the latch spoon when the latch is in closed position. The width of the latch is smaller than the width of the hook and thus substantially smaller than the width of the needle shaft. However, the result of this is that, during the casting-off process, the half-loop drags on the part of the hook tip that is not covered by the latch head and, in the worst case, is caught, thus interrupting the casting-off process. This, in turn, negatively affects the loop formation.

Another disadvantage of a male latch-female hook type needle is that the relatively narrow latch head tends to laterally slide on the hook past the inside space of the hook. This risk increases with increasing wear of the latch bearing.

A further disadvantage of a male latch-female hook type needle is that the transition from the latch shaft inside to the hook tip is not stepless when the latch is in closed position. This increases the risk that, in particular when plating, i.e., knitting with two threads, one of these two threads escapes between the closed latch and the hook. As a result, defective goods are produced.

Document DE 100 57 765 discloses one way of solving this problem. To achieve this, it is suggested to provide, on the latch shaft inside, a projection so that a stepless transition from the latch shaft inside into the hook inside space becomes possible. This solution is used in many cases, whereby the increased size of the latch due to the projection has been found to be disadvantageous, in particular in knitting machines.

Likewise, U.S. Pat. Nos. 2,282,824 and 773,722 disclose male latch-female hook type knitting machine needles that exhibit the aforementioned disadvantages.

SUMMARY OF THE INVENTION

Considering the above, the object of the invention is to provide an improved latch needle for a loop-forming machine.

In accordance with claim 1, this object is achieved with a latch needle that has the narrowest possible latch spoon. During the casting-off process, this allows the half-loop to be subjected to an at most minimal widening as it slides over the relatively narrow latch head. In addition, due to the reduced width of the latch head, compared with the known latch needles, the distance from the adjacent part (sinker), and thus the risk of contact between the sinker and the latch head, are reduced. The formation of sharp-edged borders on the latch head is avoided. No sharp edges that could damage the threads used for loop formation are formed. In particular, considering the worst case, the separation of threads, i.e., the production of defective goods, with concomitant lines of defects is prevented. The inventive latch needle combines the advantages of the male latch-female hook type needle with the advantages of the small-grooved latch needle.

The inventive latch needle has a latch whose latch head is limited by area-parallel lateral surfaces having the form of facets. The distance between these lateral surfaces represents the width of the latch head. The lateral surfaces are parallel to an imaginary plane through the center axis of the latch or of the knitting machine needle, said plane extending in longitudinal direction of the latch. The transition of the lateral surfaces to the latch head back is configured without edges, i.e., it is rounded. As a result of this, a gentle sliding of the half-loops over the closed latch back is ensured. Opposite the back of the latch head is a depression, i.e., a small groove-like recess. This groove-like recess receives at least part of the tip of the hook of the latch needle and is preferably adapted to the geometric configuration of said hook. Ideally, the groove-like recess of the latch head is an image in the sense of an inverted or negative shape of the tip of the hook, for example.

The transition from the relatively narrow latch shaft to the latch head is formed by two facets. As in a conventional latch needle, these are arranged diverging in longitudinal direction of the latch. In addition, more facets may be provided on the transition region from the latch shaft to the latch head, said facets permitting a special configuration of a receiving funnel in the latch shaft.

Across its width, the latch shaft is limited by two lateral surfaces which are aligned parallel with respect to each other. The latch shaft is supported on a bearing arrangement in the latch slit of the knitting machine needle. This bearing arrangement may be designed as a separate shaft with a pivot pin or a peg or of half-pins made up of the shaft jaws. In order to ensure the smooth movement of the latch in the latch slit, the lateral surfaces of the latch shaft may be arranged at an acute angle with respect to each other in the direction of the latch head. Consequently, the latch shaft may be somewhat wedge-shaped. The width of said shaft then decreases in the direction of the latch head. In so doing, the reduction of the width is limited to a few thousandths of a millimeter. The lateral surfaces of the latch shaft are then arranged at an acute angle relative to each other, whereby the opening direction of the angle is facing away from the latch head. Considering a latch with a tapering latch shaft, the lateral surfaces of the latch head are parallel to the lateral surfaces of the latch shaft only in vertical direction. The imaginary extension of the lateral surface of the latch head then forms, together with its adjacent lateral surface of the latch shaft, an acute angle greater than zero. The opening direction of the angle is then facing in the direction of the latch head. In other words, the lateral surface of the latch head and the lateral surface of the latch shaft subtend an oblique angle smaller than 180°.

The latch slit, in which the latch shaft is movably mounted, is provided in longitudinal direction of the knitting machine needle and is preferably located in the center of the needle shaft relative to the needle width that is measured in transverse direction of the needle. It is limited by two lateral surfaces facing each other, whereby these surfaces are provided on the shaft walls of the needle shaft and whereby the slit width is to be measured between said lateral walls. The latch slit is located between the shaft walls.

The width of the needle shaft is measured perpendicular to said shaft's lateral surfaces. This shaft width substantially corresponds to the width of the needle locator in the knitting machine or is slightly smaller, so that the longitudinal movability of the knitting machine needle is ensured.

Referring to a latch needle in accordance with the invention, the width of the latch head is preferably substantially smaller than the width of the needle shaft. Preferably, the width of the latch head amounts to 80% of the width of the needle shaft, whereby already the reduction of 5% of the width of the latch head—beginning with the width of the needle shaft—offers substantial advantages regarding distance. Ideally, the width of the latch head ranges between 70% and 90% of the width of the needle shaft. As a result of this, it is ensured that, during the oscillating motion of the latch, there is sufficient space between the lateral surface that limits the latch head and the part of a knitting machine adjacent to said lateral surface.

Another advantage of a latch head in accordance with the invention is its design. In case of contact with another component of a knitting machine, the parallel lateral surfaces of the latch head offer a surface-like abutment. Compared with a point-like site of contact, such an abutment is less prone to wear, i.e., any potential wear is minimized. Consequently, the risk that sharp edges will form in the region of the latch head has been considerably reduced.

In order for the groove-like recess of the latch head of the latch needle in accordance with the invention to receive the end of the needle hook, the needle hook has a tapered tip. This tip is configured as a tapering cone. Starting from the cross-section of the hook, this cone tapers toward the tip. The tip is rounded, so that the contact with the thread does not damage said thread.

Additional details of advantageous embodiments of the present invention are obvious from the drawings, the description and/or the claims.

BRIEF DESCRIPTION OF THE DRAWINGS

Exemplary embodiments of the invention are illustrated by the drawings.

DETAILED DESCRIPTION OF THE INVENTION

Figures 1, 2, 3, 4:
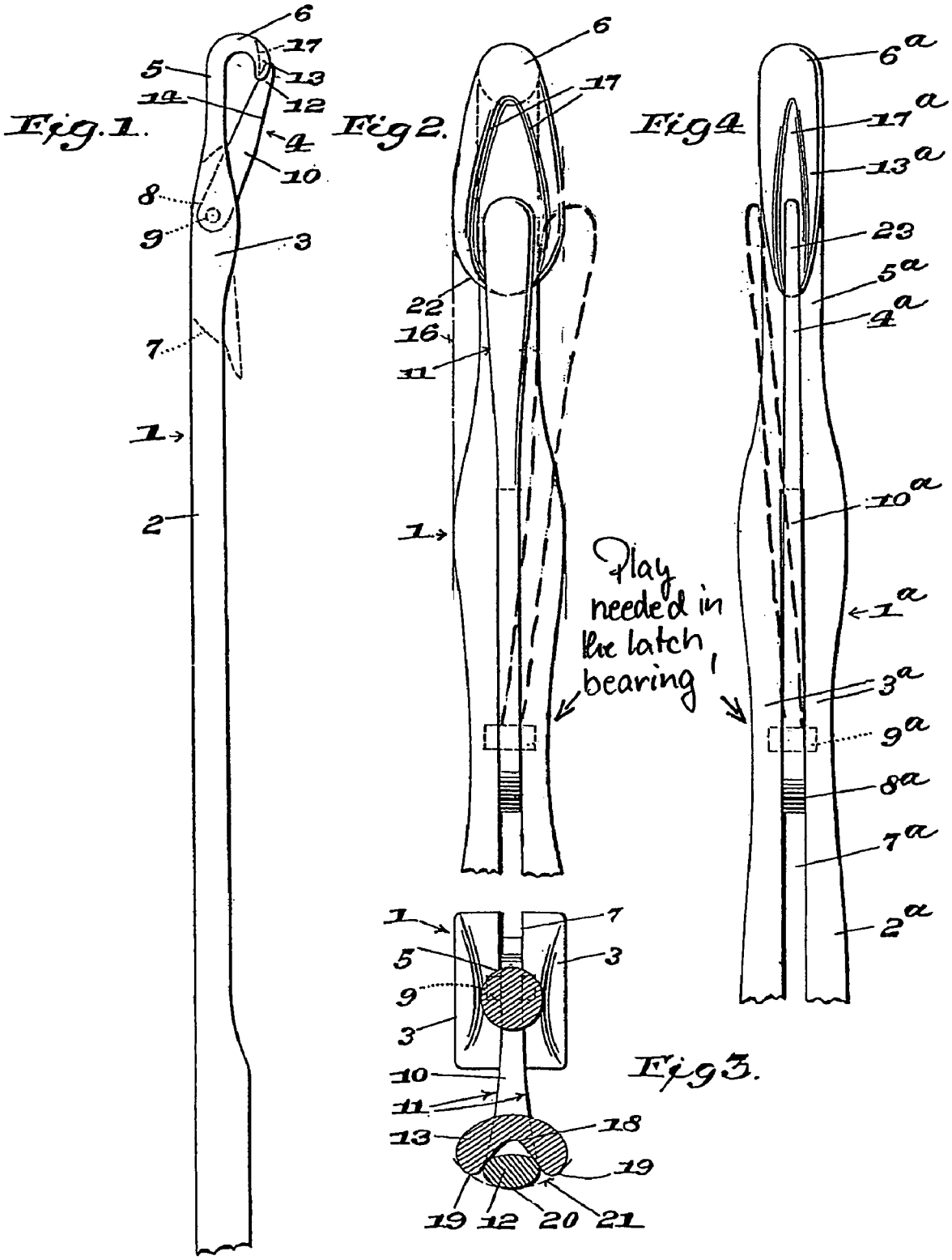
FIG. 1 is a schematic side view of a detail of a knitting machine needle with a needle latch having a width extending between two flat sides, in closed position and in rear position of the latch.
FIG. 2 is a schematic side view of the latch head of a needle latch as in FIG. 1, with the latch in closed position and in another scale.
FIG. 3 is a schematic illustration of a detail of a latch needle as in FIG. 1, in plan view.
FIG. 4 is a sectional view along line BB of the latch head as in FIG. 2, in another scale.

FIG. 1 shows a latch needle 1, which has a needle body 2 with a loop-forming part 3 having a hook 4 on its end. The hook 4 terminates in a tip 14.

On its loop-forming part 3, the needle body 2 has a latch slit 5, into which extends an end 15 of the latch 7. The latch 7 is held in the latch slit 5 on a bearing arrangement 6, so as to be pivotally supported. The bearing arrangement 6 consists of a bearing shaft extending through the latch slit 5, for example. This bearing shaft, which may be configured as a bearing pin or, preferably as a one-piece or multi-piece peg that is seamlessly connected with the needle body 2. The latch 7 is supported in such a manner such that it can be pivoted about this bearing arrangement 6 out of the closed position shown on the left side in FIG. 1 and into a rear position shown on the right side in FIG. 1. A hook inside space 10 is closed and opened, respectively, during the change from the closed position into the open position.

The latch 7 comprises a narrow shaft 8 that is preferably limited by parallel flanks and has a width that is slightly smaller than that of the latch slit 5. The length of the latch 7 is such that the end 23 of said latch may reach the upper side of the hook 4 and partially extend beyond it. In so doing, the end 23 is provided with a concave molded surface 25 facing the hook 4, said molded surface, in accordance with the exemplary embodiment of FIG. 1, forming a depression 12 for receiving at least one section of the hook 4. The molded surface 25 may correspond to the shape of the upper side 17 of the hook tip 14 and be adapted thereto. Preferably, the overall configuration is such that the depression 12 receives exclusively one part of the conical tip but not any other section of the hook 4.

Furthermore, the configuration of the end 23 of the latch 7 is obvious from FIGS. 2, 3 and 4. The end 23 has a back surface 24 which represents the rear side of an end-side spoon formed on the latch 7. The width of said spoon marks the end 23 of the latch 7. Said spoon's width 16 exceeds the width BS of the latch shaft 8 that essentially has parallel flanks (FIG. 3). The latch head width 16 is defined by the distance between a first lateral surface 21 and a second lateral surface 22 of the latch head 9 and is measured perpendicular to these. It exceeds the width BS of the latch shaft 8. The latch shaft 8 having a width BS defined by the distance between a first flat side 27 and a second flat side 28 preferably terminates in a stepless manner in the latch head 9. The width BS of the latch shaft 8, which is measured perpendicular to the flat sides 27, 28, increases steadily in the transition region until the width 16 of the latch head 9 is reached. The width BS of the latch shaft 8 may terminate in a continuous manner in the width 16 of the latch head 9. As a result of this, a preferably molded surface 26 having the shape of an isosceles trapezium may be formed on each side of the latch shaft (FIG. 2). The molded surface 26 may preferably have a flat form. However, it is also possible for said surface to exhibit a slightly convex or concave curvature.

Inasmuch as the latch head 9 has a smaller width than the part of the hook 4 below said head or the needle shaft 20—referring to the plan view of FIG. 3—the latch 7 defines a contour, which is completely within the contour of the needle shaft 20. The latch 7 does not have sections that extend laterally beyond the needle shaft 20.

The lateral surface 21, 22 of the latch head is preferably a flat surface which can extend over most of the entire latch head. It terminates without steps in the molded surface 26 and in the latch shaft 8. The lateral surfaces 21 and 22 are arranged parallel to each other. Therefore, the width 16 of the latch head 9 is essentially constant. The lateral surfaces 21 and 22, respectively, are located in a plane which is aligned parallel to another plane, in which the lateral surfaces 27 and 28, respectively, of the latch shaft 8 are located.

The latch head 9 has a depression or receiving space 12 which, when the latch 7 is in closed position, receives at least a part of the tip 14 or the hook 4. In so doing, the receiving space 12 and the hook tip 14 are adapted to each other in such a manner that the frontal region of the hook tip 14 sinks almost completely into the receiving space 12. As a result of this, it becomes possible for a thread to slide, without any obstacle, beneath the hook tip into the hook inside space 10. Also, the lower part of the hook tip 14 does not form an edge that projects relative to the lower edge of the latch head 9 when the latch is in closed position (FIG. 2). Consequently, it is possible for a thread to slide, without resistance, into the hook inside space under the hook tip and will not be caught on an edge.

The width 11 (FIG. 3) of the needle shaft 20 extends between a first lateral surface 18 and a second lateral surface 19. Said width is the same or slightly less than the width of the needle channel, in which the latch needle 1 is supported so that it may be moved back and forth. The lateral surface 18, 19 is arranged parallel to an imaginary longitudinal center axis of the latch needle 1. The two lateral surfaces 18 and 19 are arranged parallel to each other. Therefore, the width 11 is constant across a large portion of the latch needle 1. The width 16 between the lateral surfaces 21 and 22 of the latch head 9 is significantly smaller than the width 11 of the latch needle 1. Preferably, it accounts for approximately 75% of the width 11 of the latch needle 1. This applies at least to the width 11 in the region of the loop-forming part 3, e.g., measured on the bearing arrangement 6. Preferably, the width 16 is also less than the width 11, measured directly below the tip of the hook 4.

The receiving space 12 of the latch head 9 is configured in such a manner that it completely accommodates the frontal region of the hook tip 14 of the hook 4 (FIG. 4). The receiving space 12 has a molded surface 30 that is adapted to the surface of the hook tip 14. In order for the hook tip 14 to find its way into the receiving space 12, the molded surface 24 is provided with flanks that diverge away from each other. For example, said molded surface has a funnel shape.

Figure 5:
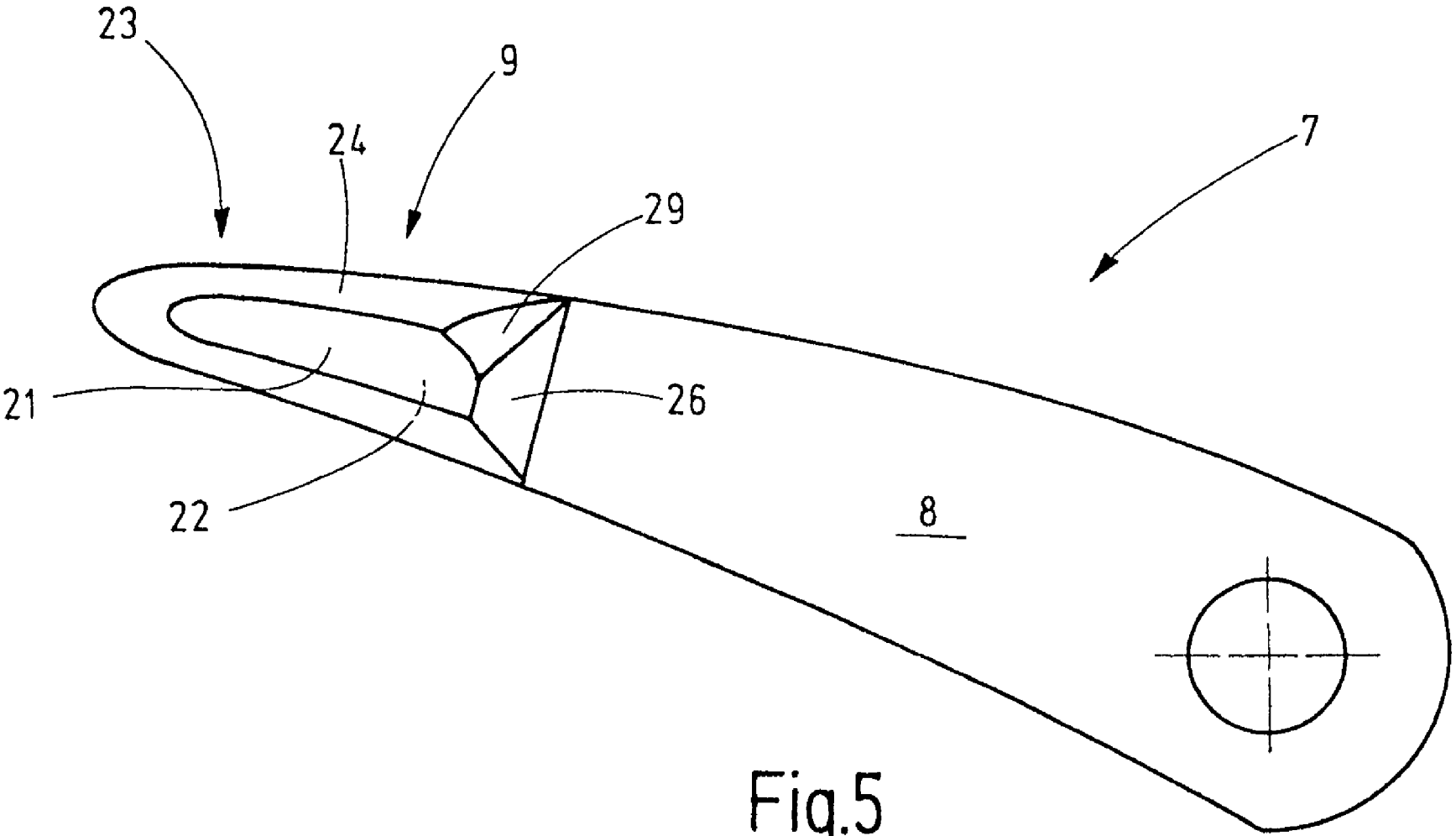
FIG. 5 is the latch of the small-grooved latch needle as in FIG. 1, in a modified embodiment and in a different scale.

FIG. 5 shows a modified embodiment of a latch 7. On its latch head 9, said latch has an additional facet 29, in addition to the lateral surface 21, 22 and the molded surface 26. The facet 29 reduces the cross-section of the latch head 9 in the transition region from the latch shaft 8 into the latch head 9. The surfaces 21, 22, 26 and 29 terminate in each other in a stepless manner and without transition, so that casting-off of the loop over the latch head 9 is not impaired. As a result of the reduction of the cross section of the latch head due to the application of the facet 29 it is possible to optimize the receiving space (not illustrated) on the latch shaft, into which the latch sinks partially when it is in open position. Preferably, two facets 29 are provided on the latch head 9, whereby one facet is associated with the lateral surface 21 and a second facet is associated with the lateral surface 22.

Figure 6:
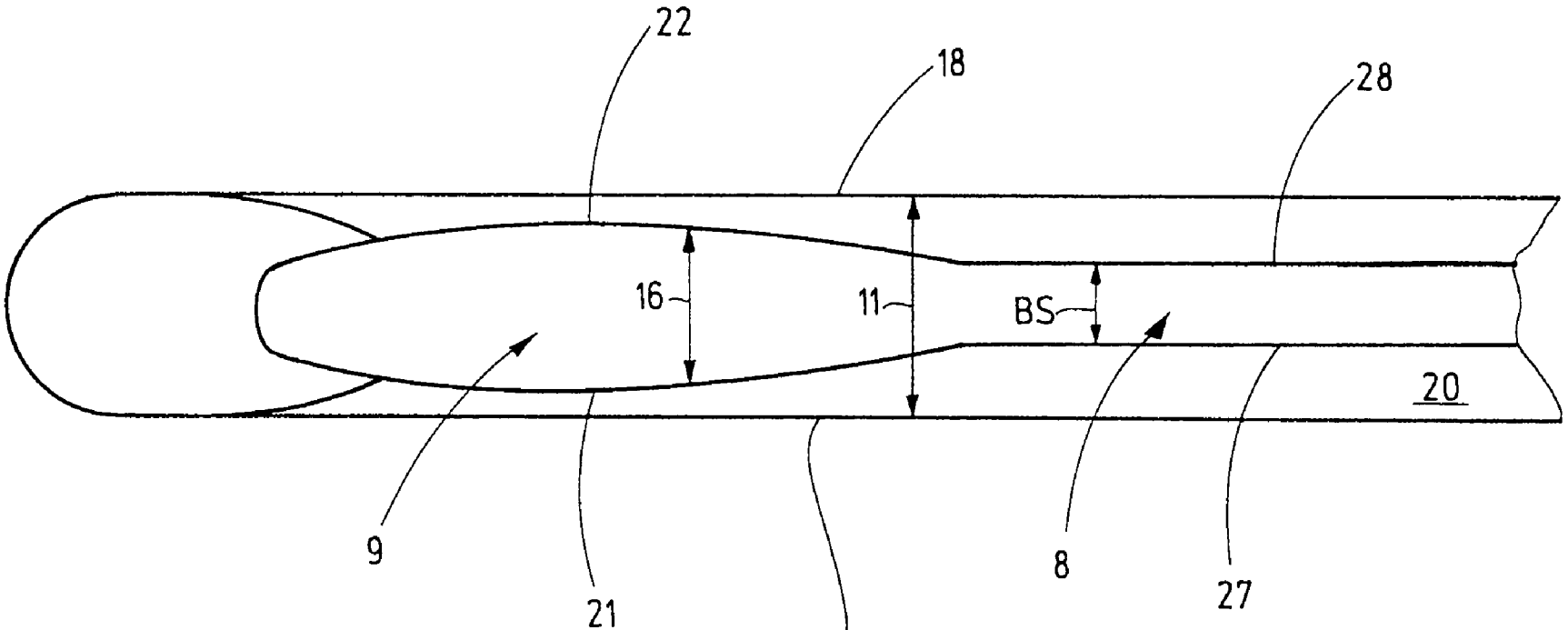
FIG. 6 is the latch of a modified embodiment of a small-grooved latch needle in accordance with the invention.

FIG. 6 shows a modified embodiment of the inventive latch needle, in which case the above description and reference numbers apply analogously. However, the lateral surfaces 21, 22 are provided with a slight curvature and thus have a convex configuration. However, they may also have a concave configuration.

All embodiments have in common that a bearing arrangement 6 exhibiting minimal play is provided. The lateral play of the latch 7, measured on the latch head, is preferably smaller—in closed position—than half of the width 16.

The latch needle 1 is disposed to operate as follows:

The latch needle 1 sits in the needle channel of a needle bed or of a needle carrier, for example, a knitting cylinder of a circular knitting machine. Said latch needle is moved back and forth along its needle shaft 20. When it is driven out, the latch 7 impacts in reverse position. A half-loop located in the then open hook inside space 10 can slide over the open latch 7 onto the needle shaft 20. In this state, the hook 4 can catch another thread.

Figure 7:
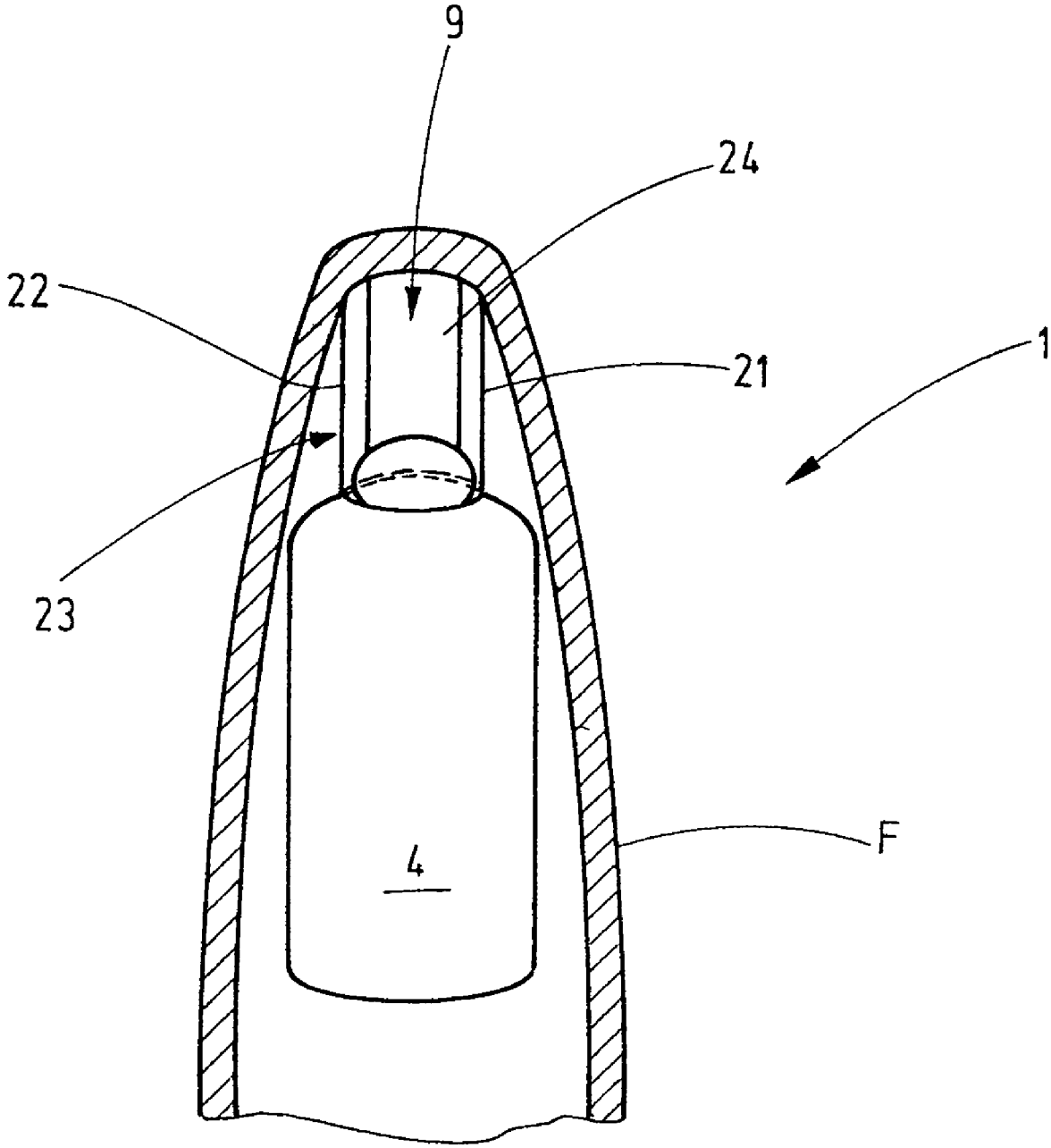
FIG. 7 is a front view of the latch needle as in FIG. 1, while a half-loop is being cast off.

During the return stroke of the latch needle 1, the latch 7 is moved into closed position. In so doing, it pivots toward the hook 4. The latch head 9 receives an upper section of the hook tip 14 in the receiving space 12 and places itself against the hook tip 14. In this state, the half-loop formed of the thread F can slide into the closed position of the latch 7, as shown by FIG. 7. Inasmuch as the latch head 9 is distinctly narrower than the shaft and thus also the hook 4, as is shown by FIG. 7, the half-loop formed of the thread F—in particular, when it slides over the latch head 9—is slightly expanded in a direction transverse to said half-loop's direction of movement. This expansion is substantially smaller than in existing small-grooved latch needles, in which the latch head 9 is wider than the hook 4. This benefits the quality of the knit material or can be used for a deliberate improvement of the knitting quality.

The inventive latch needle 1 has on its latch 7 a latch head 9 that is provided with a recess or a depression 12 for receiving a section of a tip 14 of the hook 4, said tip having the configuration of a truncated cone. The latch head 9 is wider than the latch shaft 8 of the latch 7, however, distinctly narrower than the needle shaft 20. Due to this measure, too great an expansion of the loops during the casting-off process is avoided, and the risk of a collision of the latch head with other components, for example, sinkers, is reduced.

It will be appreciated that the above description of the present invention is susceptible to various modifications, changes and adaptations, and the same are intended to be comprehended within the meaning and range of equivalents of the appended claims.

LIST OF REFERENCE NUMBERS

1 Latch needle
2 Needle body
3 Loop-forming part
4 Hook
5 Latch slit
6 Bearing arrangement
7 Latch
8 Latch shaft
9 Latch head
10 Hook inside space
11 Shaft width
12 Receiving space
13 --
14 Hook tip
15 Latch end
16 Latch head width
17 Hook upper side
18 Lateral surface of needle shaft
19 Lateral surface of needle shaft
20 Needle shaft
21 Lateral surface of latch head
22 Lateral surface of latch head
23 Latch end
24 Back surface
25 Molded surface
26 Molded surface
27 Lateral surface of latch shaft
28 Lateral surface of latch shaft
29 Facet
30 Molded surface
BS Width of latch shaft
F Thread

The invention claimed is:

1. Latch needle for a loop-forming textile machine a knitting machine, comprising:

a needle body (2) having a needle shaft (20) with a shaft width (11), said shaft width to be measured between a first lateral surface (18) and a second lateral surface (19), and having a loop-forming part (3) with a hook (4) and a latch slit (5), and with a bearing arrangement (6) located in the latch slit (5), a latch (7) having a latch shaft, which is pivotally supported on the bearing arrangement (6) and bears a latch head provided with a receiving space for receiving the tip of the hook and having a width that is to be measured between a first lateral surface and a second lateral surface; and wherein the latch is supported so as to be pivotable between a rear position and a closed position, in the closed position, the latch head receiving space interacts with and receives the tip of the hook, at least partially, within the receiving space in order to form a hook inside space, and the width of the latch head is smaller than 95% of the width of the needle shaft.

2. Latch needle in accordance with claim 1, wherein the width of the latch head ranges within 70% to 80% of the width of the needle shaft.

3. Latch needle in accordance with claim 1, wherein the lateral surfaces of the latch head are aligned parallel with respect to each other.

4. Latch needle in accordance with claim 1, wherein the latch shaft is limited by a first lateral surface and by a second lateral surface, whereby a width of the latch shaft is to be measured between these first and second lateral surfaces of the latch shaft.

5. Latch needle in accordance with claim 4, wherein the lateral surfaces of the latch shaft are aligned parallel with respect to each other.

6. Latch needle in accordance with claim 4, wherein the lateral surfaces of the latch shaft are arranged with respect to each other so as to form an acute angle, wherein the opening direction of the angle extends away from the latch head.

7. Latch needle in accordance with claim 4, wherein each lateral surface of the latch head is located in a respective plane, each lateral surface of the latch shaft is located in a respective plane, and these planes are aligned parallel with respect to each other.

8. Latch needle in accordance with claim 4, wherein the lateral surface of the latch head is located in one plane, the lateral surface of the latch shaft is located in one plane, and, together, these two planes subtend an angle.

9. Latch needle in accordance with claim 1, wherein each the lateral surface of the latch head is a flat surface.

10. Latch needle in accordance with claim 1, wherein the width of the latch head is constant along the lateral surfaces of the latch head.

11. Latch needle in accordance with claim 1, wherein each lateral surface of the latch head is provided with a curvature.

12. Latch needle in accordance with claim 1, wherein the lateral surfaces of the needle shaft are aligned parallel with respect to each other.

13. Latch needle in accordance with claim 1, wherein each lateral surface of the latch head is located in a respective plane, each lateral surface of the needle shaft is located in a respective plane, and these planes are aligned parallel with respect to each other.

14. Latch needle in accordance with claim 4, wherein the width of the latch head is greater than the width of the latch shaft.

15. Latch needle in accordance with claim 1, wherein the width of the latch head is greater than a width defined by the latch slit.

16. Latch needle in accordance with claim 2, wherein the width of the latch head is 75% of the width of the needle shaft.

17. Latch needle in accordance with claim 1, wherein the tip of the hook is conical with a rounded end, and the receiving space is a depression formed in a surface of the latch head.

18. Latch needle in accordance with claim 17, wherein the depression has a shape corresponding to the tip of the hook and has flanks that diverge away from each other.

* * * * *